US006763672B1

(12) United States Patent
Anderson et al.

(10) Patent No.: US 6,763,672 B1
(45) Date of Patent: Jul. 20, 2004

(54) DISPENSING A BEVERAGE

(75) Inventors: Iain Wallace Anderson, Staffordshire (GB); Peter Thomas Foster, Staffordshire (GB); Stuart William Molzahn, Derbyshire (GB); Stephen Paul Smith, Derbyshire (GB); Wendy Gladys Box, Staffordshire (GB); Rachel Joanna Galt, Staffordshire (GB); David Edwin Quain, Staffordshire (GB); Alan Robert Wright, Derbyshire (GB)

(73) Assignee: Coors Worldwide Inc., Golden, CO (US)

( * ) Notice: Subject to any disclaimer, the term of this patent is extended or adjusted under 35 U.S.C. 154(b) by 0 days.

(21) Appl. No.: 10/337,037

(22) Filed: Jan. 6, 2003

(51) Int. Cl.[7] ..... F21D 21/14
(52) U.S. Cl. ..... 62/289
(58) Field of Search ..... 62/289, 390; 222/146.6

(56) References Cited

U.S. PATENT DOCUMENTS 3,733,840 A * 5/1973 Pearl et al. ..... 62/78
4,058,383 A * 11/1977 Peterson ..... 62/85
4,961,456 A * 10/1990 Stembridge et al. ..... 141/1
5,148,996 A * 9/1992 Fletcher et al. ..... 241/36
5,958,481 A 9/1999 Hodges ..... 426/100
6,349,853 B1 * 2/2002 Grampassi ..... 222/144.5
6,378,740 B1 * 4/2002 Martin ..... 222/389
6,428,689 B1 * 8/2002 Kameyama et al. ..... 210/120

FOREIGN PATENT DOCUMENTS

| | | |
|---|---|---|
| FR | 2747888 | 10/1997 |
| GB | 2287306 | 9/1995 |
| JP | 60210696 | 10/1985 |
| JP | 1262779 | 10/1989 |
| JP | 404311353 A * | 11/1992 |

OTHER PUBLICATIONS

Pub. No.: US 2003/0070446 A1 to Scullion et al. Pub. Date Apr. 17, 2003.*

* cited by examiner

*Primary Examiner*—William E. Tapolcai
*Assistant Examiner*—Mohammad M. Ali
(74) *Attorney, Agent, or Firm*—Baker Botts LLP

(57) ABSTRACT

A beverage, for example a draught beverage, which may already be cooled before introduction into a drinking vessel is introduced into the vessel into which additional cooled material is introduced. The cooled material may be frozen water which is used to dilute the beverage to a desired strength e.g. a desired alcoholic strength. Alternatively the cooled material may be frozen beverage.

12 Claims, 2 Drawing Sheets

DISPENSING A BEVERAGE

Figure 1:
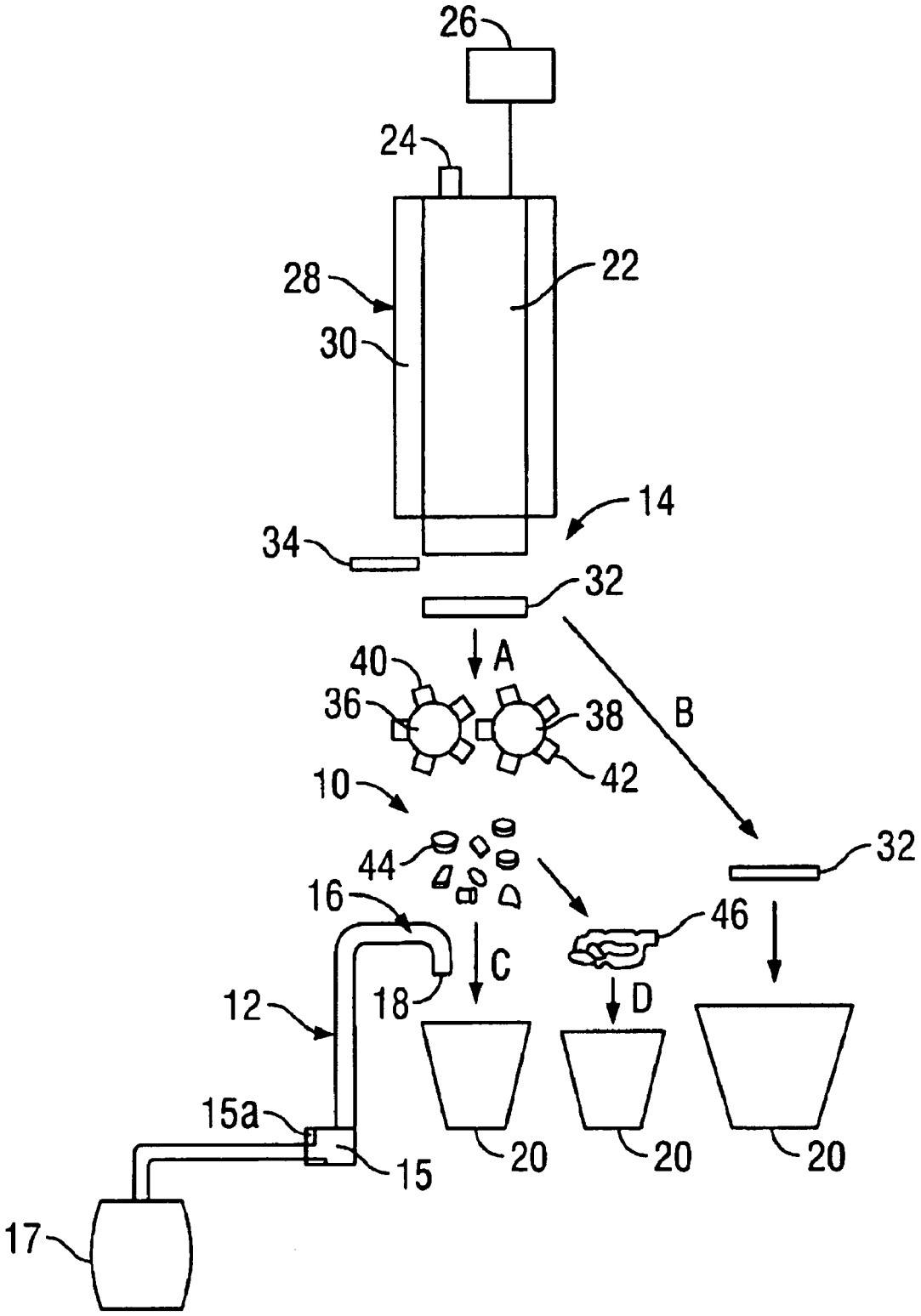

This invention concerns serving or dispensing a beverage, and a served or dispensed beverage.

For example the invention may concern dispensing a draught beverage and more particularly the dispensing of cooled draught beverage.

According to a first aspect of the invention there is provided a method of dispensing beverage comprising delivering a beverage into a vessel and introducing cooled material into the vessel in addition to the beverage.

Preferably the cooled material is frozen. More preferably the cooled material is cooled beverage. Preferably the draught beverage is supplied from a beverage source and the cooled beverage is obtained from said source.

The cooled beverage may be cooled after having been obtained from said source and before being introduced into the vessel. Preferably the cooled beverage is at least partially frozen before being introduced into the vessel. The cooled beverage may be cooled to form a slush. Alternatively the cooled beverage may be frozen to a substantially solid form, which is then broken down before being introduced into the vessel. Preferably the frozen beverage is broken down into parts so as to form at least one of crushed ice, ground ice, ice slices and ice granules. Preferably the parts are of different sizes. For example the parts may be slices of different thicknesses.

Preferably in the source comprises a container of beverage. Preferably the beverage is dispensed at a font and the cooled material is introduced into the vessel at the font. The cooled material may be added to the beverage so as to dilute the beverage to a required strength. For example said strength may be an alcoholic strength. Preferably the beverage is selected from the group consisting of beer and cider. For example the beverage may be lager.

The cooled material may be introduced into the vessel before the beverage, after the beverage, or simultaneously with the beverage.

Preferably the cooled material is introduced into the vessel at a lower temperature than the beverage is dispensed into the vessel.

The present invention further provides apparatus for dispensing a draught beverage into a vessel, the apparatus comprising a dispensing nozzle for dispensing the beverage into the vessel and a cooled material dispenser for introducing cooled material into the vessel. Preferably the cooled material dispenser is arranged to dispense frozen material. More preferably the cooled material dispenser is arranged to dispense cooled beverage.

Preferably the dispensing nozzle and the cooled material dispenser are connected to a common source of beverage. More preferably the apparatus further comprises cooling means arranged to cool beverage from the source before it is supplied to the cooled material dispenser. Preferably the cooling means is arranged to at least partially freeze the beverage before it is introduced into the vessel. The cooling means may be arranged to cool the beverage to form a slush. Alternatively the cooling means may be arranged to freeze the beverage to a substantially solid form, and the apparatus further comprises at least one of a grinder, a crusher or a slicer for breaking down the frozen beverage.

Preferably the source comprises a container of beverage. Preferably the apparatus comprises a font which includes the dispensing nozzle and the cooled material dispenser. Desirably the apparatus is arranged to control the volumes of the dispensed beverage and the cooled material so as to dilute the beverage to a required strength, for example an alcoholic strength.

The apparatus may be is arranged to introduce the cooled material into the vessel before the beverage, after before the beverage, or simultaneously with the beverage. Preferably the cooled material dispenser is arranged to introduce the cooled material into the vessel at a lower temperature than the beverage is dispensed into the vessel from the dispensing nozzle.

The present invention further provides a beverage which has been dispensed according to the method of the invention.

The present invention still further provides apparatus for preparing a vessel to receive a beverage the apparatus comprising cooling means arranged to at least partially freeze a portion of the beverage, and delivery means arranged to dispense the at least partially frozen beverage into a drinking vessel.

Attention is drawn to two International patent applications, namely International Application No. PCT/GB99/03824 (published under No. WO01/36582) and International Application No. PCT/GB99/01551 (published under no. WO 99/60092). Any individual feature or any combination of such features of any beverage disclosed in either of those International Applications, and any method or apparatus or part of any method or apparatus disclosed in either of those International Applications, may be utilised in the serving or dispensing of beverage which in the subject of this current application.

Figure 2:
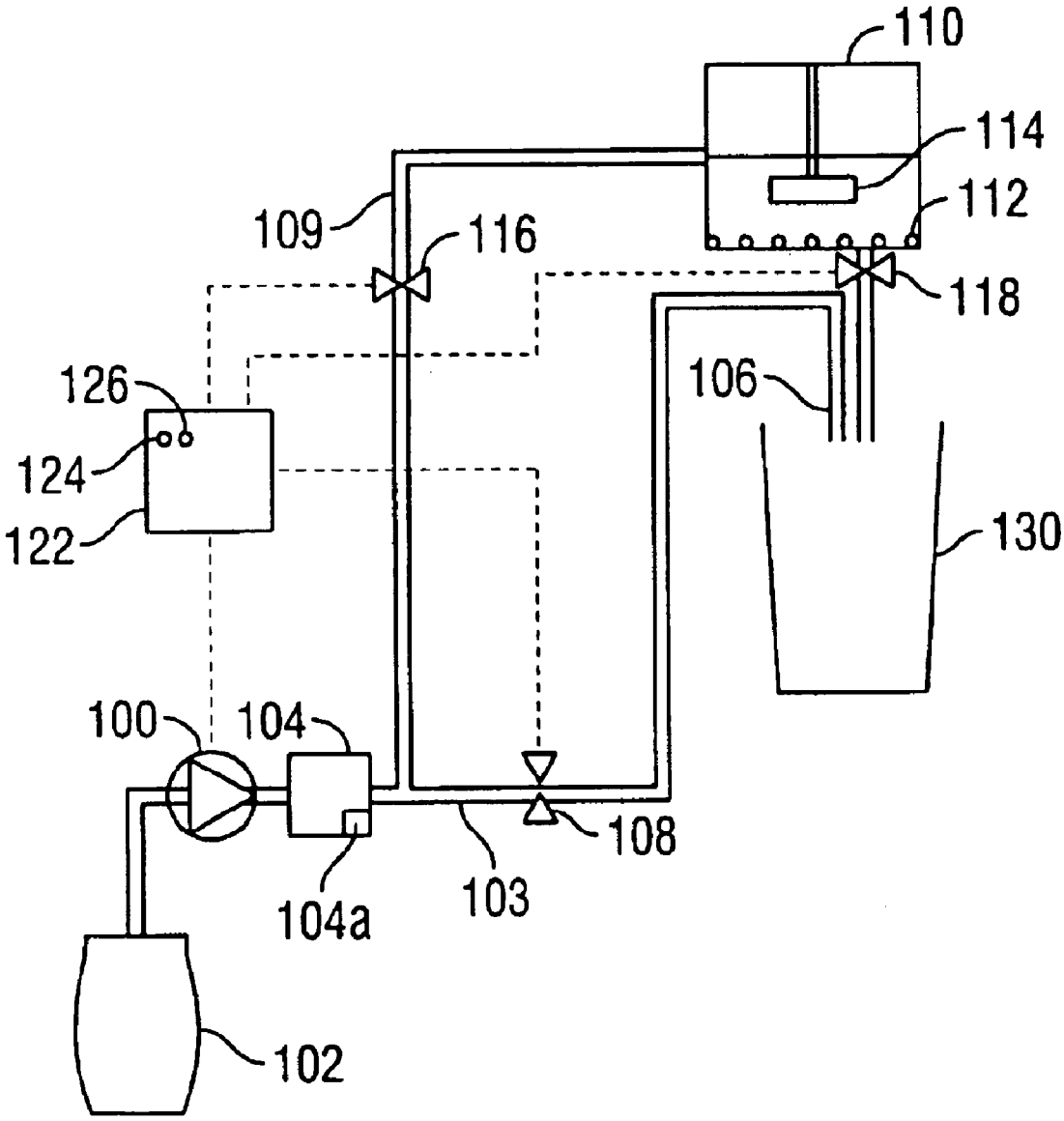

Preferred embodiments of the present invention will now be described by way of example only with reference to the accompanying drawings in which:

FIG. 1 is a schematic view of a beverage dispensing system according to a first embodiment of the invention; and FIG. 2 is a schematic representation of a beverage dispensing system according to a second embodiment of the invention.

Referring to FIG. 1, a draught beverage dispensing system 10 includes a font 12 and an ice making unit 14.

The font 12 includes a cooling unit 15, a valve 16, and a nozzle 18. Upon the opening of the valve 16 the beverage to be dispensed is drawn, from a keg 17, through the cooling unit 15 and out of the nozzle 18 into a glass 20.

The ice making unit 14 includes a cylinder 22 of circular cross-section which is substantially closed at its upper end and substantially open at its lower end, the lower end having removable closure (not shown) in order to prevent egress of liquid during the initial freezing process. An inlet 24 is mounted in the upper end of the cylinder 22 so as to allow ingress of a liquid. The liquid can be water, but in this embodiment the inlet 24 is connected to the keg 17 of beverage so that the beverage is used to make ice in the unit 14.

The cylinder 22 is connected to a primary cooling system 26 in order to freeze the liquid within the cylinder 22. A second, optional, cooling system 28 involves the enclosure of the cylinder 22 in a longitudinally extending annular jacket 30 containing a liquefied gas. The liquefied gas could for example be liquid nitrogen to further cool the frozen liquid to, for example, approximately −20° C. to −30° C.

To dispense a beverage, a volume of beverage is dispensed from the keg 17 via the cooling unit 15 into the vessel, at a temperature which is just above the freezing point of the beverage, in this case between 1° C. and 2° C. This volume is less than the total volume of beverage required.

A portion of the frozen liquid, in the form of ice 32, projects from the open lower end of the cylinder 22, either under gravity or is forced out, for example by hydraulic means. This portion, or slice, of the ice 32 is cut from the main body of ice either by use of a microtone cutter 34 or by cleaving with a pair of blades (not shown). The cut ice has a volume which, when added to the beverage in the vessel 20, will make up the total volume of beverage required.

The ice 32 is added directly to the glass 20 of beverage (as denoted by B in FIG. 1). The ice can be added as a single slice, or as a plurality of slices. These may be of different thicknesses so that some of them will melt more quickly than others. However, as an alternative, the ice 32 may pass between a pair of drums 36,38 which rotate about their parallel longitudinal axes with a plurality of mutually engaging teeth 40,42 projecting radially therefrom (denoted by A in FIG. 1). The teeth 40, 42 crush or grind the ice 32 into granules 44. The granules 44 can be immediately added to the dispensed beverage (as denoted by C in FIG. 1) or can be left to partially melt and form a slush 46 which is then added to the dispensed beverage (as denoted by D in FIG. 1).

The ice can be introduced into the vessel 20 either before the liquid beverage, or after the liquid beverage, or while the liquid beverage is being dispensed.

In a modification to this embodiment the cooling unit 15 includes a temperature sensor 15*a* and the thickness of the slice of ice 32, or the number of slices of ice 32, added to the beverage is controlled according to the temperature of the beverage entering the vessel, so as to control the final temperature of the beverage when the ice has melted.

In a further modification to this embodiment the beverage dispense nozzle is omitted and the apparatus is used with bottled beverage which is placed in the vessel 20 by a person serving the beverage.

In a modification of this embodiment the beverage is frozen into small, discrete, portions to be added to the dispensed beverage.

The addition of the ice 32 to the dispensed beverage serves to reduce the temperature of the beverage and particularly in the case of water slush 46 may also dilute the beverage, in the case of soft beverages to a desired strength of concentrate and in the case of alcoholic beverages to the desired alcohol content.

Referring to FIG. 2, in a second embodiment of the invention a beverage dispensing system comprises a pump 100 which is connected to a keg 102 of beverage and arranged to pump beverage from the keg through a feed pipe 103, via a cooling unit 104 to a dispense nozzle 106. A dispense valve 108 controls the flow of beverage from the cooling unit 104 to the dispense nozzle 106. A second feed pipe 109 connects the first feed pipe 103 at a point just downstream of the cooling unit 104 to slush tank 110. The slush tank 110 includes a cooling element 112 and a paddle 114 and is arranged to cool and stir the beverage in the tank so as to form a slush made up of a of frozen and liquid beverage. A slush tank inlet valve 116 controls the flow of beverage from the cooling unit 104 to the slush tank 110, and a slush dispense valve 118 controls the flow of slush from the tank 110 to a slush nozzle 120.

A control unit 122 controls the operation of the pump 100 and the valves 108, 116, 118, and includes an input panel having two buttons 124, 126 which allow an operator to select the dispense of a large (pint) or small (half pint) volume of beverage.

In operation, when one of the buttons 124, 126 is pressed to select a volume of beverage to be dispensed, the control unit activates the pump 100 and then opens the dispense valve 108 so that a predetermined volume of beverage passes through the cooling unit 104 and into the vessel 130 beneath the nozzle 106, at a temperature which is just above the freezing point of the beverage, in this case between 0° C. and 1° C. The slush dispense valve 118 is also opened to dispense a predetermined volume of slush into the vessel. The volume of slush and beverage dispensed make up the total volume of beverage required, and because the slush is made up of beverage, the contents of the whole dispensed beverage is the same as if solely liquid beverage had been dispensed.

The cooling unit 104 can include a temperature sensor 104*a* to measure the temperature of the beverage dispensed into the control the vessel 130, such that the control unit 122 can control the amount of slush added to the liquid beverage, thereby to control the final temperature of the beverage.

The order in which the slush and beverage are dispensed can be varied: the slush can be dispensed before, during, or after dispense of the liquid beverage.

When the dispensing of the slush is complete, the valve 116 is opened to refill the slush tank 110 with beverage.

We claim:

1. A method of dispensing a predetermined volume of a draught liquid beverage into a vessel, the beverage being selected from the group consisting of beer and cider, the method comprising providing a source comprising a container of the liquid beverage, a dispensing nozzle connected to the source, and cooling means connected to the source, dispensing a first volume of the liquid beverage from the source through the dispensing nozzle into a vessel, cooling the liquid beverage from the source using the cooling means to at least partially freeze the beverage, and introducing a second volume of the at least partially frozen beverage from the cooling means into the vessel, wherein the first volume and the second volume are controlled so as to add up to said predetermined volume.

2. The method according to claim 1 wherein the beverage is cooled by the cooling means to form a slush.

3. The method according to claim 1 wherein the cooled beverage is frozen by the cooling means to a substantially solid form, which is then broken down before being introduced into the vessel.

4. The method according to claim 3 wherein the frozen beverage is broken down into parts so as to form at least one of crushed ice, ground ice, ice slices and ice granules.

5. The method according to claim 4 wherein the parts are of different sizes.

6. The method according to claim 5 wherein the parts are slices of different thicknesses.

7. The method according to claim 1 wherein the beverage is dispensed at a font and the cooled beverage is induced into the vessel at the font.

8. A beverage which has been dispensed according to the method of claim 1.

9. An apparatus for dispensing a predetermined volume of a draught liquid beverage into a vessel, the beverage being selected from the group consisting of beer and cider, the apparatus comprising a source comprising a container of the liquid beverage, a dispensing nozzle connected to the source for dispensing the beverage as a liquid into the vessel, cooling means connected to the source and arranged to at least partially freeze the beverage a cooled beverage dispenser connected to the cooling means for introducing at least partially frozen beverage from the cooling means into the vessel and control means arranged to control the volume of beverage dispensed as a liquid to a first volume, and the volume of the at least partially frozen beverage introduced into the vessel to a second volume, whereby the first and second volumes add up to the predetermined volume.

10. The apparatus according to claim 9 wherein the cooling means is arranged to cool the beverage to form a slush.

11. The apparatus according to claim 9 wherein the cooling means is arranged to freeze the beverage to a substantially solid form and the apparatus further comprises at least one of a grinder, a crusher, and a slicer for breaking down the frozen beverage.

12. The apparatus according to claim 9 comprising a font which includes the dispensing nozzle and the cooled material dispenser.

* * * * *